US010474084B2

(12) United States Patent
Yokoyama

(10) Patent No.: US 10,474,084 B2
(45) Date of Patent: Nov. 12, 2019

(54) IMAGE FORMING APPARATUS AND CONTROL METHOD FOR AN IMAGE FORMING APPARATUS

(71) Applicant: CANON KABUSHIKI KAISHA, Tokyo (JP)

(72) Inventor: Masashi Yokoyama, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/216,185

(22) Filed: Dec. 11, 2018

(65) Prior Publication Data

US 2019/0187604 A1 Jun. 20, 2019

(30) Foreign Application Priority Data

Dec. 20, 2017 (JP) ..... 2017-243742

(51) Int. Cl.
*G03G 15/08* (2006.01)
*G03G 15/00* (2006.01)

(52) U.S. Cl.
CPC ..... *G03G 15/556* (2013.01); *G03G 15/0853* (2013.01); *G03G 15/0865* (2013.01); *G03G 15/5016* (2013.01); *G03G 2215/0888* (2013.01)

(58) Field of Classification Search
CPC .. G03G 15/553; G03G 15/0863; G03G 15/55; G03G 15/0849; G03G 21/1875; G03G 21/1892
See application file for complete search history.

(56) References Cited

U.S. PATENT DOCUMENTS

2012/0148267 A1* 6/2012 Kawai ..... G03G 15/5079 399/8
2015/0104200 A1 4/2015 Matsumoto
2016/0216670 A1* 7/2016 Eda ..... G03G 15/5012

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus is configured to determine that a toner container was replaced during power off in a case where identification information acquired from a toner container and identification information stored in a nonvolatile memory do not match each other when power is turned on. In a case where the replaced toner container does not satisfy a replacement condition and does not contain a black toner, the image forming apparatus permits the execution of printing in a monochrome print mode, and suspends the execution of printing in the color print mode.

14 Claims, 10 Drawing Sheets

FIG. 8A

△THE FOLLOWING TONER CONTAINER HAS BEEN DETACHED WITH SOME TONER STILL LEFT.
PERFORM RESTORATION OPERATION.
·YELLOW
RESTORATION OPERATION:
DETACH THE TONER CONTAINER OF THE ABOVE COLOR.
THEN, SET AGAIN THE TONER CONTAINER THAT WAS SET BEFORE THE REPLACEMENT.

FIG. 8B

△THE TONER CONTAINER OF THE FOLLOWING COLOR THAT CAN BE USED CONTINUOSLY HAS BEEN DETACHED.
PERFORM RESTORATION OPERATION.
·YELLOW
RESTORATION OPERATION:
DETACH THE TONER CONTAINER OF THE ABOVE COLOR.
THEN, SET AGAIN THE TONER CONTAINER THAT WAS SET BEFORE THE REPLACEMENT.
NOTE: PRINTING IN MONOCHROME MODE IS ALLOWED WITHOUT RESTORATION OPERATION

OK

FIG. 8C

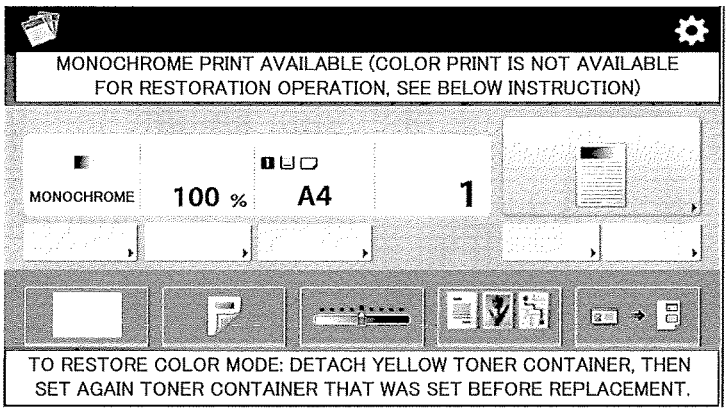

IMAGE FORMING APPARATUS AND CONTROL METHOD FOR AN IMAGE FORMING APPARATUS

BACKGROUND OF THE INVENTION

Field of the Invention

The present disclosure relates to an image forming apparatus configured to form an image using developer, and more particularly, to an image forming apparatus to which a container configured to contain developer is attachably and detachably provided.

Description of the Related Art

An electrophotographic image forming apparatus forms an image by developing an electrostatic latent image formed on a photosensitive member using developer in a developing device. The developing device has a limit to an amount of developer that can be stored therein. Therefore, a container configured to contain developer is used. The container is attachably and detachably provided to an image forming apparatus. The image forming apparatus appropriately replenishes the developing device with developer from the mounted container. There is also a limit to the amount of developer that can be contained in the container. In a case where there is no developer remaining in the container, the developing device cannot be replenished with developer from the container. In that case, the image forming apparatus notifies a user that the container requires replacement.

The user sometimes replaces the container even in a case where there is developer having an amount equal to or larger than a predetermined amount remaining in the container. There is proposed an image forming apparatus configured to display, in such a case, a screen for warning that there is developer remaining in the container to suspend a print job until the original container is mounted again (Pub. No.: US 2015/0104200 A1). This image forming apparatus notifies the user that it is not the timing to replace the container. Therefore, it is possible to avoid the replacement of the container in which developer remains, and to inhibit a resource from being wasted.

In a related-art image forming apparatus, in a case where the container is replaced during power off, a warning screen is displayed at the next startup. In a case where a user who starts up the image forming apparatus is different from a user who replaced the container during power off, it is difficult for the user who has started up the image forming apparatus to restore the original container from the replaced container. In this case, there is a fear that the user who has started up the image forming apparatus may not be able to cancel a suspended state of the print job, and may not be able to perform printing. Further, an image forming apparatus configured to form an image with developers of a plurality of colors suspends all print jobs in a case where there is even one container that is not restored. Therefore, for example, in a case where the developer in the replaced container has a chromatic color, a print job in a monochrome print mode that uses only developer of black, the container of which has not been replaced, is also brought to a suspended state. In this case, the user may feel inconvenience. The present disclosure has an object to provide an image forming apparatus configured to reduce an influence exerted on the user by a suspended state of a print job involved in the replacement of a container.

SUMMARY OF THE INVENTION

An image forming apparatus according to the present invention includes: an image forming unit configured to form an image on a sheet, the image forming unit including: a first developing unit configured to develop a color image using developer of a chromatic color; and a second developing unit configured to develop a black image using developer of black; a first mount, to which a first container is to be mounted, the first container being configured to contain the developer of the chromatic color; a second mount, to which a second container is mounted, the second container being configured to contain the developer of black; a replenishment mechanism configured to replenish the first developing unit with the developer of the chromatic color from the mounted first container, and replenish the second developing unit with the developer of black from the mounted second container; and a controller configured to: determine whether the first container is required to be replaced; suspend, in a case where it is not determined that the first container is required to be replaced and the first container is replaced by another first container, image formation for the color image performed by the image forming unit; and permit, in a case where it is not determined that the first container is required to be replaced and the first container is replaced by the another first container, image formation for the black image performed by the image forming unit.

Further features of the present invention will become apparent from the following description of exemplary embodiments (with reference to the attached drawings).

BRIEF DESCRIPTION OF THE DRAWINGS

FIG. 8A, FIG. 8B, and FIG. 8C are diagrams for illustrating examples of a screen.

DESCRIPTION OF THE EMBODIMENTS

Now, an embodiment of the present disclosure is described in detail with reference to the accompanying drawings.

Image Forming Apparatus

Figure 1:
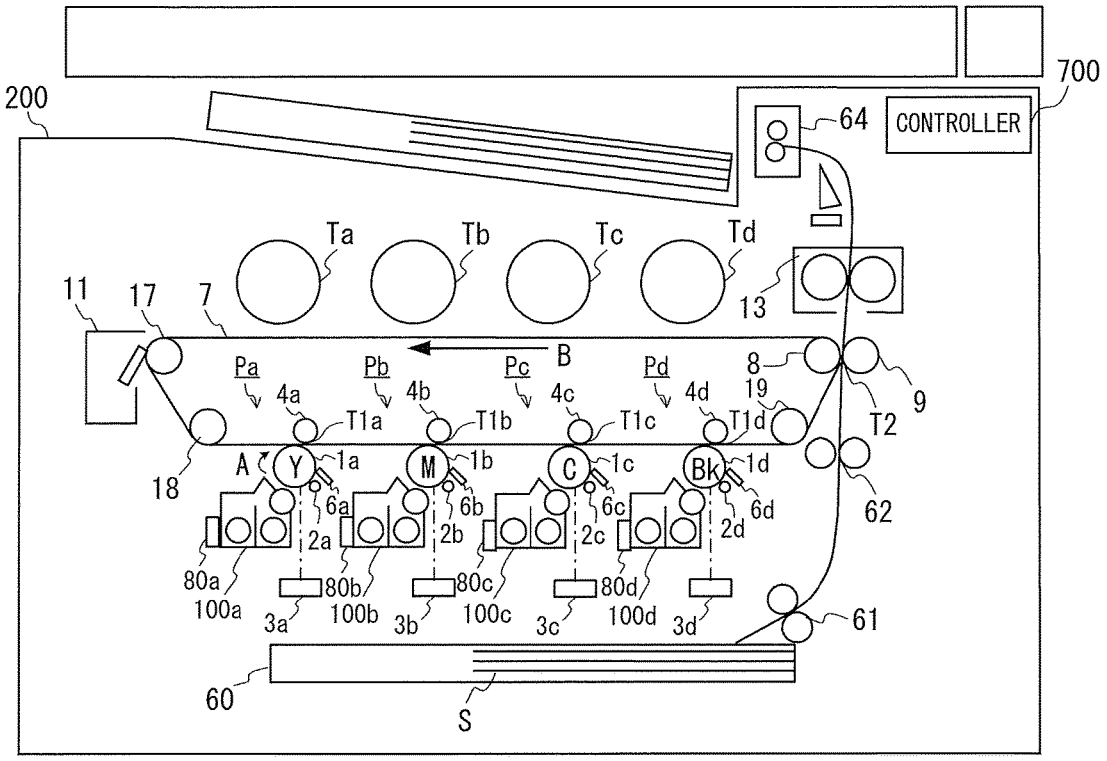
FIG. 1 is a configuration diagram of an image forming apparatus.

FIG. 1 is a configuration diagram of an image forming apparatus 200. The image forming apparatus 200 includes four image formers Pa, Pb, Pc, and Pd configured to form toner images of different color components, which are arranged side by side in a rotation direction of an intermediate transfer belt 7. The image former Pa forms a toner image of yellow being a chromatic color. The image former Pb forms a toner image of magenta being a chromatic color. The image former Pc forms a toner image of cyan being a chromatic color. The image former Pd forms a toner image of black. In the image forming apparatus 200, toner containers (toner bottles) Ta, Tb, Tc, and Td each being a container configured to contain a toner as developer are attachably and detachably mounted. The toner container Ta contains the toner of yellow. The toner container Tb contains the toner of magenta. The toner container Tc contains the toner of cyan. The toner container Td contains the toner of black. The toner containers Ta, Tb, Tc, and Td each supply the toner being the developer to a developing device of the image former configured to form the toner image of the corresponding color.

The image formers Pa, Pb, Pc, and Pd have the same configuration. The following description is directed to the image former Pa configured to form the toner image of yellow, and descriptions relating to the other image formers Pb, Pc, and Pd are omitted.

The image former Pa includes a photosensitive drum 1*a*, a charger 2*a*, a laser exposure device 3*a*, and a developing device 100*a*. The photosensitive drum 1*a* is a photosensitive member having a photosensitive layer on a surface of a metal roller. The photosensitive drum 1*a* is rotated in a direction indicated by an arrow A. The charger 2*a* charges the photosensitive layer of the photosensitive drum 1*a*. The laser exposure device 3*a* exposes the photosensitive layer of the photosensitive drum 1*a*, which has been charged by the charger 2*a*, based on image data on the color component of yellow. An electrostatic latent image having the color component of yellow is thus formed on a surface of the photosensitive drum 1*a*. The developing device 100*a* stores the developer (toner). The developing device 100*a* uses the toner to develop the electrostatic latent image formed on the surface of the photosensitive drum 1*a*. A toner image is thus formed on the photosensitive drum 1*a*. The developing device 100*a* includes a toner concentration sensor 80*a* configured to detect an amount of the developer (toner) in the developing device 100*a*. In a case where the toner concentration sensor 80*a* detects that an amount of the toner in the developing device 100*a* has decreased below a predetermined amount, the developing device 100*a* is replenished with the toner of yellow from the toner container Ta containing the toner of yellow.

The image former Pa includes a primary transfer roller 4*a*. The primary transfer roller 4*a* transfers the toner image, which has been formed on the photosensitive drum 1*a*, onto the intermediate transfer belt 7. During the transfer, the primary transfer roller 4*a* brings the photosensitive drum 1*a* and the intermediate transfer belt 7 into contact with each other to form a primary transfer nip portion T1*a*. While the toner image formed on the photosensitive drum 1*a* is passing through the primary transfer nip portion T1*a*, a primary transfer voltage is applied to the primary transfer roller 4*a*. The toner image on the photosensitive drum 1*a* is thus transferred onto the intermediate transfer belt 7. The image former Pa includes a drum cleaner 6*a*. The drum cleaner 6*a* removes the toner remaining on the photosensitive drum 1*a* after the transfer.

The intermediate transfer belt 7 is stretched around a secondary transfer opposing roller 8, a driven roller 17, a first tension roller 18, and a second tension roller 19. The intermediate transfer belt 7 is rotated in a direction indicated by an arrow B by rotational drive of the secondary transfer opposing roller 8. The toner images of the respective colors, which have been formed by the image formers Pb to Pc in the same manner as in the case of the image former Pa, are sequentially transferred onto the intermediate transfer belt 7 in accordance with rotation of the intermediate transfer belt 7. A toner image in full color is thus formed on the intermediate transfer belt 7. The intermediate transfer belt 7 is rotated so as to convey the transferred toner image in the direction indicated by the arrow B.

A secondary transfer roller 9 is arranged at a position opposed to the secondary transfer opposing roller 8 across the intermediate transfer belt 7. The secondary transfer opposing roller 8 and the secondary transfer roller 9 form a secondary transfer nip portion T2. The intermediate transfer belt 7 and a sheet S are sandwiched thereby at the secondary transfer nip portion T2. A secondary transfer voltage is applied to the secondary transfer opposing roller 8, to thereby cause the toner image on the intermediate transfer belt 7 to be transferred onto the sheet S at the secondary transfer nip portion T2. A belt cleaner 11 removes the toner remaining on the intermediate transfer belt 7 after the transfer.

The sheet S is stored in a cassette portion 60. The sheet S is fed from the cassette portion 60 by a sheet feeding roller (not shown). The fed sheet S is conveyed to conveyance rollers 61. The conveyance rollers 61 convey the sheet S fed from the cassette portion 60 to registration rollers 62. The registration rollers 62 perform, for example, skew feed correction for the sheet S. The registration rollers 62 convey the sheet S to the secondary transfer nip portion T2 in accordance with a timing at which the toner image on the intermediate transfer belt 7 is conveyed to the secondary transfer nip portion T2.

The sheet S onto which the toner image has been transferred at the secondary transfer nip portion T2 is conveyed to a fixing device 13. The fixing device 13 includes a fixing roller including a heater and a pressure roller. The fixing device 13 fixes the toner image to the sheet S by heat generated by the heater and pressure applied between the fixing roller and the pressure roller. The sheet S to which the toner image has been fixed is delivered from the image forming apparatus 200 by delivery rollers 64. Printed matter is generated by forming the image on the sheet S through the above-mentioned image forming operation.

The image forming apparatus 200 performs the above-mentioned image forming operation based on the image data acquired from, for example, a personal computer (not shown) or a scanner (not shown). The image forming operation is described below. The image forming operation is controlled by a controller 700 built into the image forming apparatus 200.

In a case where the image forming operation is started, the photosensitive drums 1*a*, 1*b*, 1*c*, and 1*d* start to be rotated in the direction indicated by the arrow A. The chargers 2*a*, 2*b*, 2*c*, and 2*d* uniformly charge the surfaces of the photosensitive drums 1*a*, 1*b*, 1*c*, and 1*d*. The laser exposure devices 3*a*, 3*b*, 3*c*, and 3*d* expose the photosensitive drums 1*a*, 1*b*, 1*c*, and 1*d* based on the image data. In this manner, the electrostatic latent images of the respective color components corresponding to the image data are formed on the photosensitive drums 1*a*, 1*b*, 1*c*, and 1*d*.

The developing devices 100*a*, 100*b*, 100*c*, and 100*d* develop the electrostatic latent images on the photosensitive drums 1*a*, 1*b*, 1*c*, and 1*d*, to thereby form the toner images of the respective color components on the photosensitive drums 1*a*, 1*b*, 1*c*, and 1*d*. The toner images on the photosensitive drums 1*a*, 1*b*, 1*c*, and 1*d* are conveyed to the primary transfer nip portions T1*a*, T1*b*, T1*c*, and T1*d* in accordance with the rotation of the photosensitive drums 1*a*, 1*b*, 1*c*, and 1*d*. At the primary transfer nip portions T1*a*, T1*b*, T1*c*, and T1*d*, the toner images of the respective color components on the photosensitive drums 1*a*, 1*b*, 1*c*, and 1*d* are transferred onto the intermediate transfer belt 7 by the primary transfer rollers 4*a*, 4*b*, 4*c*, and 4*d*. The toner image in full color is thus formed on the intermediate transfer belt 7. The toners remaining on the photosensitive drums 1*a*, 1*b*, 1*c*, and 1*d* after the transfer are removed by the drum cleaners 6*a*, 6*b*, 6*c*, and 6*d*.

The sheet S is fed from the cassette portion 60 in accordance with the timing at which the toner images start to be formed on the photosensitive drums 1*a*, 1*b*, 1*c*, and 1*d*. The fed sheet S is conveyed toward the registration rollers 62 by the conveyance rollers 61. The registration rollers 62 adjust the timing to convey the sheet S to the secondary transfer nip portion T2 so that the toner image on the intermediate transfer belt 7 is to be transferred onto the sheet S at a predetermined position. The secondary transfer roller 9 causes the toner image on the intermediate transfer belt 7 to be transferred onto the sheet S at the secondary transfer nip portion T2. The toner remaining on the intermediate transfer belt 7 without being transferred onto the sheet S at the secondary transfer nip portion T2 is removed by the belt cleaner 11.

The sheet S bearing the toner image is conveyed to the fixing device 13. The fixing device 13 fixes an unfixed toner image to the sheet S through melting. The sheet S that has passed through the fixing device 13 is delivered from the image forming apparatus 200 by the delivery rollers 64. The image forming apparatus 200 generates the printed matter by forming the image based on the image data on the sheet S by such an image forming operation.

The image forming apparatus 200 can perform image formation in a color print mode of generating printed matter in full color, which uses the toners of the respective colors of yellow, magenta, cyan, and black, and in a monochrome print mode of generating monochrome printed matter, which uses only the toner of black. A user selects any one of the modes to instruct the image forming apparatus 200 to perform the image formation in the selected mode. The image forming apparatus 200 performs the image formation in the mode based on the instruction received from the user.

Controller

Figure 2:
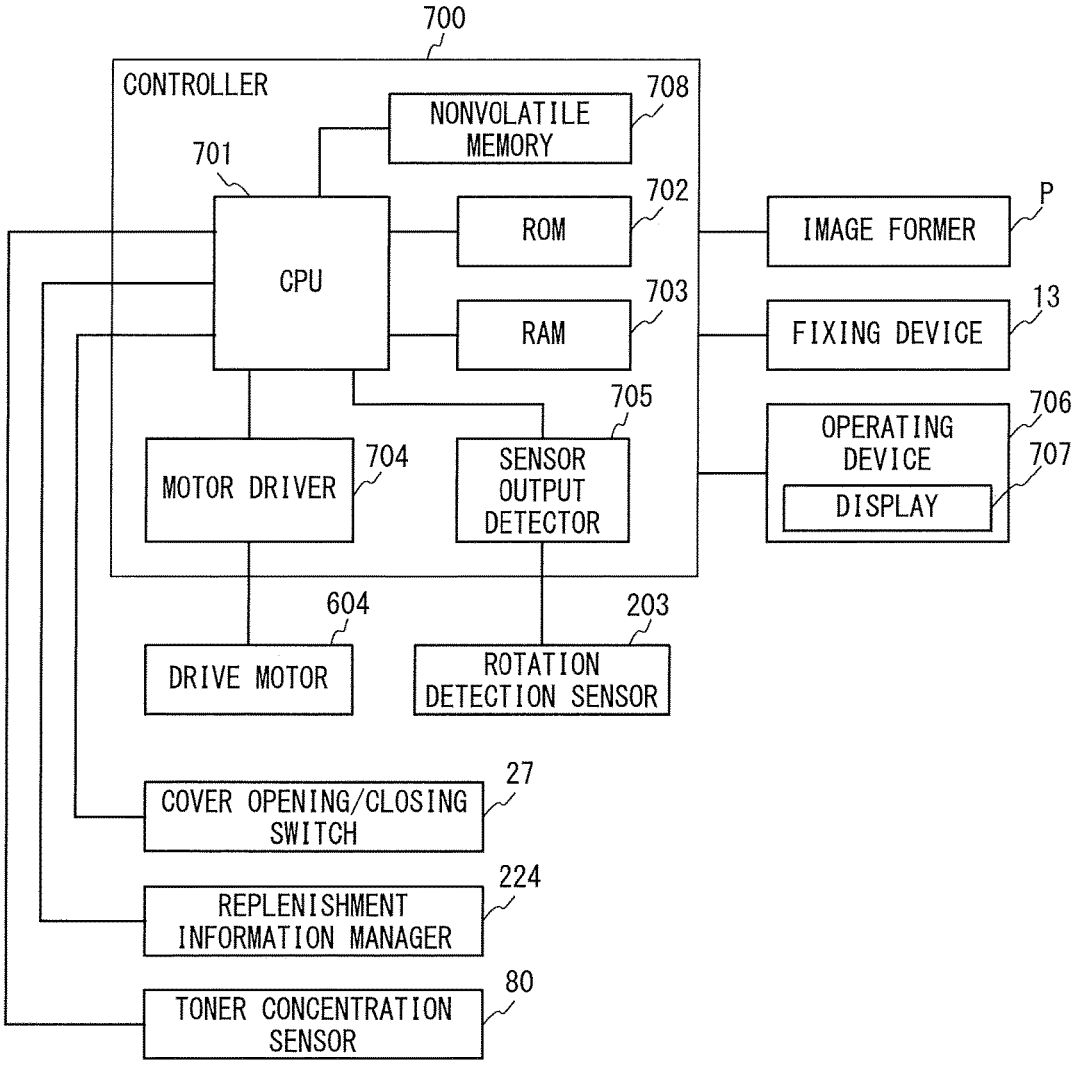
FIG. 2 is a configuration diagram of a controller.

FIG. 2 is a configuration diagram of the controller 700. In the following description, the symbols "a", "b", "c", and "d" for distinguishing colors are omitted when the description does not require distinction of colors. For example, the toner containers Ta, Tb, Tc, and Td are referred to as "toner container T".

The controller 700 is connected to the image former P, the fixing device 13, and the toner concentration sensor 80, which are described above. In addition, the controller 700 is connected to an operating device 706, a drive motor 604, a rotation detection sensor 203, a cover opening/closing switch 27, and a replenishment information manager 224.

The controller 700 is a computer system including a central processing unit (CPU) 701, a read-only memory (ROM) 702, and a random-access memory (RAM) 703. The CPU 701 uses the RAM 703 as a work area to execute a control program for controlling different kinds of processing, which is stored in the ROM 702, to thereby control an operation of each component of the image forming apparatus 200. The controller 700 includes a motor driver 704, a sensor output detector 705, and a nonvolatile memory 708. The CPU 701 causes the motor driver 704 to control the drive motor 604. The CPU 701 causes the sensor output detector 705 to acquire a detection result from the rotation detection sensor 203. The nonvolatile memory 708 stores information (replenishment information) relating to the toner container T, which is described later.

The drive motor 604 is a drive source configured to rotate the toner container T in order to replenish the developing device 100 with a toner from the toner container T. The motor driver 704 controls the drive motor 604. To control the drive motor 604, the motor driver 704 controls a current to be supplied to the drive motor 604. The drive motor 604 is controlled by pulse width modulation (PWM). The CPU 701 uses a PWM signal to set a control value indicating a time period for supplying the current per unit time. The CPU 701 inputs the PWM signal to the motor driver 704. The motor driver 704 controls an amount of the current to be supplied to the drive motor 604 based on the PWM signal. In this embodiment, a direct current motor (DC brush motor) is used as the drive motor 604. Therefore, a rotation speed and a rotational drive force of the drive motor 604 are determined based on a time ratio of the current to be supplied to the drive motor 604 per predetermined time period.

The motor driver 704 can supply the current to the drive motor 604 while acquiring an enable signal (ENB signal) from the CPU 701. That is, while acquiring the ENB signal from the CPU 701, the motor driver 704 supplies a current corresponding to the PWM signal to the drive motor 604 to drive the drive motor 604. The motor driver 704 drives the drive motor 604, to thereby rotationally drive the toner container T. In a case where the CPU 701 stops the ENB signal, the motor driver 704 stops supplying the current to the drive motor 604. This causes the drive motor 604 to stop operating, to thereby stop rotation of the toner container T.

The rotation detection sensor 203 is an optical sensor including a light emitter and a light receiver. The rotation detection sensor 203 outputs a signal corresponding to an amount of light emitted from the light emitter and received by the light receiver. While a predetermined region of the toner container T is passing through a detection position of the rotation detection sensor 203, the amount of the light received by the light receiver decreases below a threshold value. While a region other than the predetermined region of the toner container T is passing through the detection position of the rotation detection sensor 203, the amount of the light received by the light receiver is equal to or larger than the threshold value. In this manner, in a case where the predetermined region of the toner container T passes through the detection position of the rotation detection sensor 203, the rotation detection sensor 203 detects the rotation of the toner container T. A specific configuration of the rotation detection sensor 203 is described later.

The sensor output detector 705 acquires an output signal from the rotation detection sensor 203. The sensor output detector 705 outputs a low-level signal in a case where the output signal exhibited with the amount of the received light being equal to or larger than the threshold value is acquired from the rotation detection sensor 203. The sensor output detector 705 outputs a high-level signal in a case where the output signal exhibited with the amount of the received light being smaller than the threshold value is acquired from the rotation detection sensor 203. That is, the sensor output detector 705 outputs the high-level signal while the predetermined region of the toner container T is passing through the detection position of the rotation detection sensor 203, and outputs the low-level signal while the region other than the predetermined region of the toner container T is passing through the detection position. The CPU 701 can detect the rotation of the toner container T based on the signal output from the sensor output detector 705. For example, the CPU 701 can detect one rotation of the toner container T based on the fact that the signal output from the sensor output detector 705 has been changed from a high level to a low level and then again to a high level.

The toner concentration sensor 80 outputs a signal corresponding to magnetic permeability that changes based on, for example, an amount of the toner in the developing device 100. The toner concentration sensor 80 may be configured as any sensor that can detect the amount of the toner in the developing device 100. The CPU 701 converts an output signal from the toner concentration sensor 80 into a toner concentration based on a conversion table (not shown). The CPU 701 performs control for replenishing the developing device 100 with a toner from the toner container T so that the toner concentration reaches a target concentration.

The operating device 706 is a user interface, and includes an input device and an output device. Examples of the input device include different kinds of key buttons and a touch panel. Examples of the output device include a display 707 being a touch panel. The operating device 706 transmits to the CPU 701 an instruction input by the user through use of the key buttons and the touch panel. The operating device 706 displays screens including a home screen, a replacement screen, a warning screen, and a guidance screen on the display 707 based on signals from the CPU 701. The operating device 706 notifies the user of a state of the image forming apparatus 200 based on a signal from the CPU 701. The output device may be, for example, a monitor connected to the image forming apparatus 200 via a network so as to enable communication therebetween.

The replenishment information manager 224 manages the replenishment information on the toner container T mounted in the image forming apparatus 200. As described later in detail, the toner container T includes a memory configured to store the replenishment information. The replenishment information manager 224 is a reader/writer configured to access the memory to read the replenishment information and to write the replenishment information acquired from the CPU 701 to the memory. The replenishment information includes, for example, a color of toner contained in the toner container T, identification information on the toner container T, a serial number of the toner container T, and a replenishment history of the toner container T. The replenishment history of the toner container T includes, for example, information on the number of rotations of the toner container T. The CPU 701 causes the replenishment information manager 224 to update the information on the number of rotations of the toner container T each time one rotation of the toner container T is detected based on the signal output from the sensor output detector 705. The toner container T stores the accumulated information on the number of rotations. An amount of the toner to be supplied to the developing device 100 per rotation is determined for the toner container T. Therefore, the number of rotations of the toner container T corresponds to the number of times that the developing device 100 is replenished with the toner from the toner container T, and indicates a replenishment amount of the toner.

The motor driver 704, the sensor output detector 705, the rotation detection sensor 203, and the replenishment information manager 224 are provided for each color. The drive motor 604 may be provided for each color, but may be configured so that, for example, a plurality of toner containers T are rotated by a single drive motor. One drive motor 604 can selectively rotate the plurality of toner containers T using a clutch configured to control a state in which a drive force can be transmitted from the drive motor 604 to the toner container T and a state in which the drive force cannot be transmitted from the drive motor 604 to the toner container T.

Figure 3:
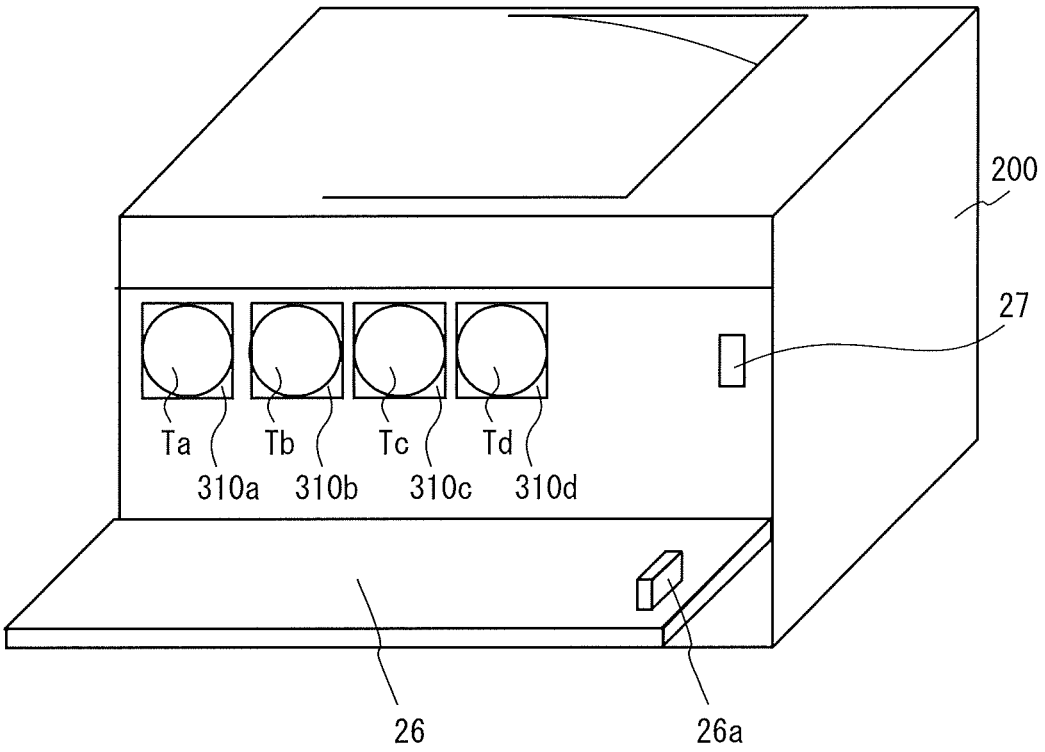
FIG. 3 is an external view of the image forming apparatus.

The cover opening/closing switch 27 transmits an opening/closing detection signal to the CPU 701 in accordance with the opening or closing of a cover provided to the image forming apparatus 200. The opening/closing detection signal is, for example, a binary signal. The CPU 701 detects an open state or a closed state of the cover based on the opening/closing detection signal. For example, in a case where the opening/closing detection signal is at a low level, the CPU 701 determines that the cover is in the closed state. In a case where the opening/closing detection signal is at a high level, the CPU 701 determines that the cover is in the open state. With reference to FIG. 3, the opening or closing of the cover is described.

FIG. 3 is an external view of the image forming apparatus 200. In FIG. 3, a cover 26 is in an open state. The opening or closing of the cover 26 is detected by the cover opening/closing switch 27. In a case where the cover 26 is in an open state, a mount 310, to which the toner container T is to be mounted, is exposed. The cover 26 is opened or closed by the user when the toner container T is attached or detached. The cover 26 includes a protruding portion 26*a*. When the cover 26 is closed, the protruding portion 26*a* presses the cover opening/closing switch 27. When the cover 26 is closed to cause the protruding portion 26*a* to press the cover opening/closing switch 27, the cover opening/closing switch 27 outputs a low-level opening/closing detection signal. When the cover 26 is opened to cancel the pressing of the protruding portion 26*a*, the cover opening/closing switch 27 outputs a high-level opening/closing detection signal. The cover 26 may be configured to open or close only the mount 310. In another case, the cover 26 may be configured to open or close the entirety of one side surface of the image forming apparatus 200.

Mount

Figure 4A:
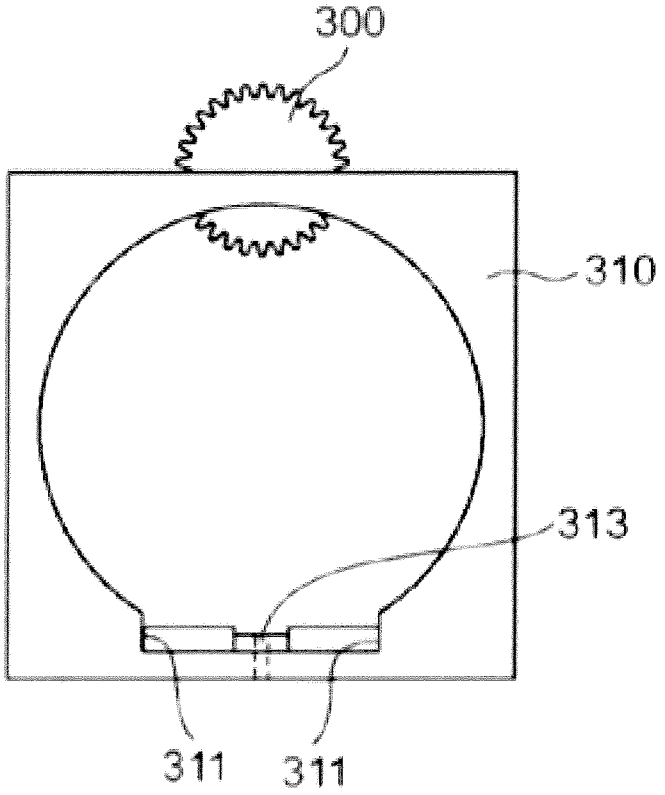
FIG. 4A and FIG. 4B are explanatory diagrams of a configuration of a mount.
Figure 4B:
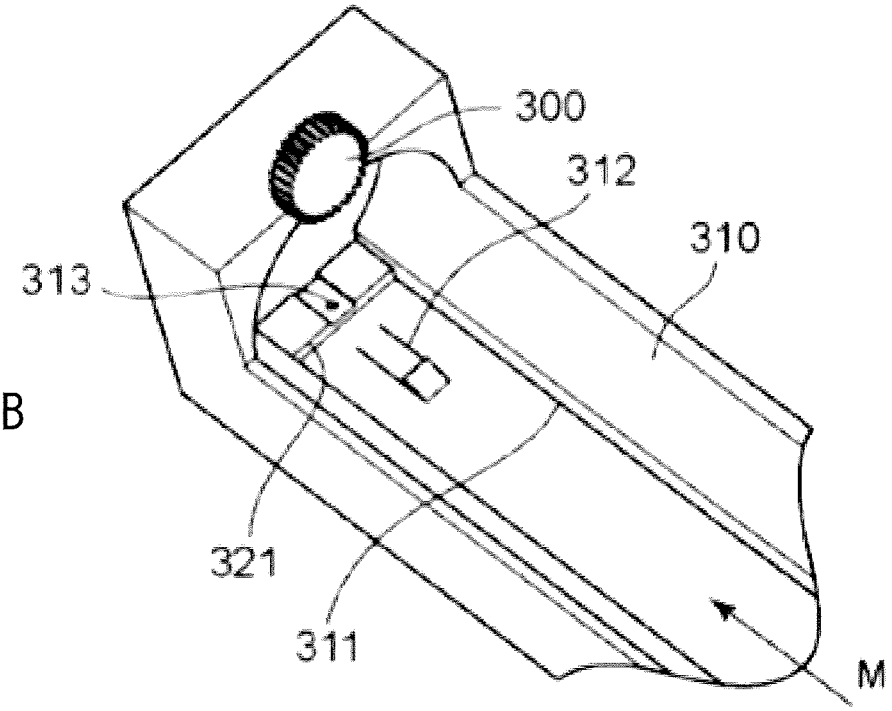

FIG. 4A and FIG. 4B are explanatory diagrams of a configuration of a mount. FIG. 4A is a partial front view of the mount 310 as viewed from the front in a direction of mounting the toner container T. FIG. 4B is a perspective view for illustrating the inside of the mount 310. As illustrated in FIG. 4B, the toner container T is inserted into the mount 310 in a direction indicated by an arrow M. The direction indicated by the arrow M is the same as a direction of a rotation axis of each of the photosensitive drums 1*a*, 1*b*, 1*c*, and 1*d* of the image forming apparatus 200. When being detached from the mount 310, the toner container T is pulled out in a direction reverse to the direction indicated by the arrow M.

The mount 310 includes a driving gear 300, a rotation regulation portion 311, a bottom portion 321, and a regulating portion 312. The driving gear 300 transmits a rotational drive force from the drive motor 604 to the toner container T mounted to the mount 310. The toner container T discharges toner by being rotated. The rotation regulation portion 311 regulates a cap portion of the toner container T, which is described later, so as not to be rotated in accordance with rotation of the toner container T. The rotation regulation portion 311 is engaged with the cap portion of the toner container T, to thereby regulate the movement along a direction of a rotation axis of the cap portion.

The bottom portion 321 communicates to a toner outlet of the mounted toner container T, and an inlet 313 configured to receive the toner discharged from the toner container T is formed in the bottom portion 321. The toner discharged from the outlet of the toner container T passes through the inlet 313 to be supplied to the developing device 100. In this embodiment, the diameter of the inlet 313 is the same as the diameter of the outlet of the toner container T, and is, for example, about 2 mm.

Toner Container

Figure 5A:
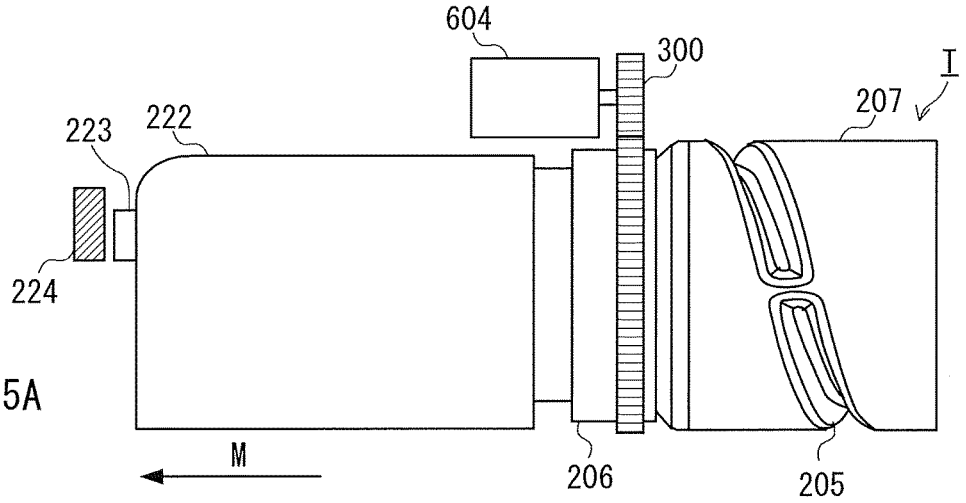
FIG. 5A, FIG. 5B, and FIG. 5C are explanatory diagrams of a toner container.
Figure 5B:
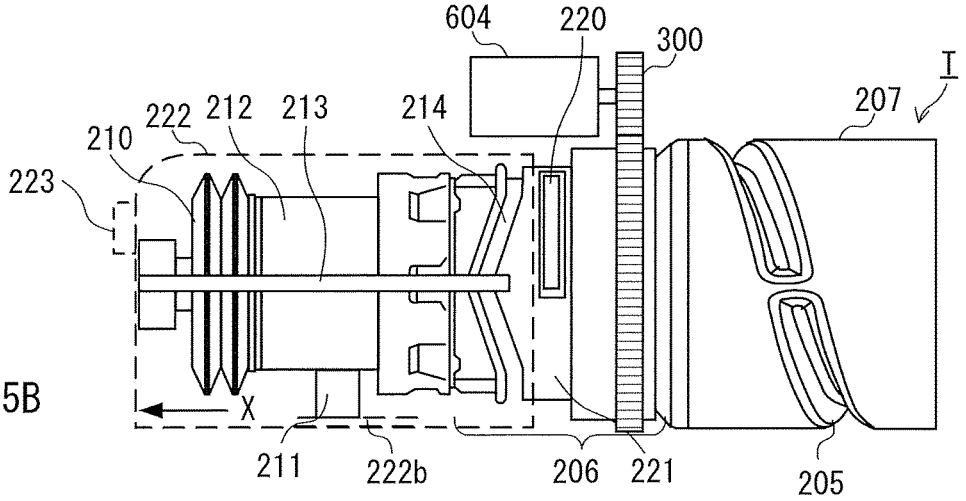
Figure 5C:
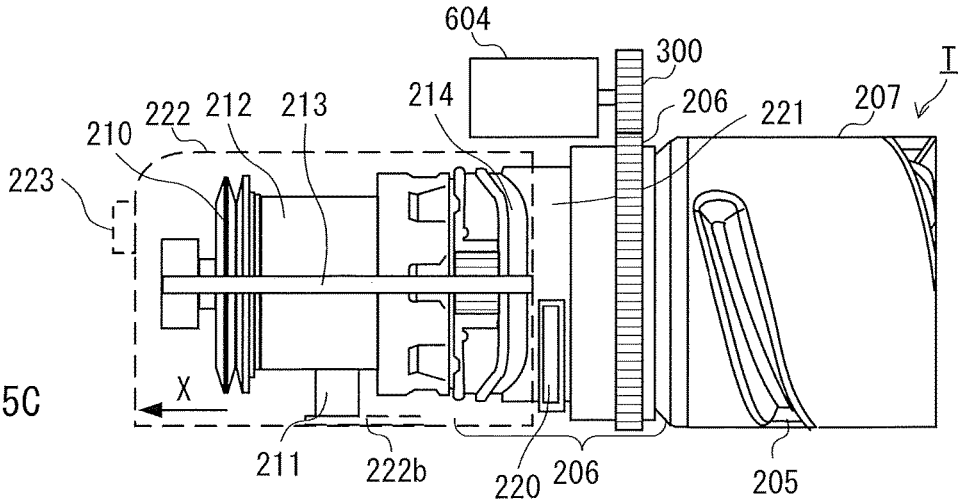

FIG. 5A, FIG. 5B, and FIG. 5C are explanatory diagrams of the toner container T. FIG. 5A is an external view of the toner container T mounted to the mount 310. FIG. 5B and FIG. 5C are explanatory diagrams of an internal structure of the toner container T mounted to the mount 310. The toner container T includes a storage portion 207 configured to contain toner, a drive transmission portion 206, to which a rotational drive force is to be transmitted from the drive motor 604 via the driving gear 300, and a cap portion 222 including a configuration for discharging the toner. The cap portion 222 includes, in its inside, a discharge portion 212 including an outlet 211 for discharging the toner, a pump portion 210 for discharging the toner inside the discharge portion 212 from the outlet 211, and a reciprocating member 213 configured to expand and contract the pump portion 210.

The drive transmission portion 206 includes a convex portion 220, a detected portion 221, and a cam groove 214. The cam groove 214 is formed around the drive transmission portion 206 by one round in a rotation direction of the drive transmission portion 206. The cam groove 214, the detected portion 221, and the convex portion 220 are integrally formed to be rotated as the drive transmission portion 206. The drive transmission portion 206 and the storage portion 207 coupled to the drive transmission portion 206 are rotated by the rotational drive force transmitted from the drive motor 604 to the drive transmission portion 206 of the toner container T via the driving gear 300.

In the storage portion 207, a convex portion 205 is formed so as to protrude toward the inside. The convex portion 205 is helically formed along an outer periphery of the storage portion 207. The convex portion 205 causes the toner inside the storage portion 207 to be conveyed to the discharge portion 212 side in accordance with rotation of the storage portion 207.

The cap portion 222 has the rotation regulated by the mount 310 as described above, and is not rotated even in a case where the drive transmission portion 206 is rotated at the time of mounting. The outlet 211, the pump portion 210, and the reciprocating member 213 are also regulated so as not to be rotated in the same manner as the cap portion 222. Therefore, even in a case where the drive transmission portion 206 is rotated, the outlet 211, the pump portion 210, and the reciprocating member 213 are not rotated.

A rotation regulation groove is formed inside the cap portion 222. The rotation regulation groove regulates the reciprocating member 213 so as not to be rotated in a case where the drive transmission portion 206 is rotated. To that end, the reciprocating member 213 is engaged with the rotation regulation groove. The reciprocating member 213 is connected to the pump portion 210, and a claw portion (not shown) is engaged with the cam groove 214 of the drive transmission portion 206. The rotation of the drive transmission portion 206 causes the reciprocating member 213 to move along the cam groove 214 while being regulated so as not to be rotated. With this configuration, the reciprocating member 213 reciprocates in a direction indicated by an arrow X (longitudinal direction of the toner container T).

The reciprocating member 213 is coupled to the pump portion 210. With reciprocation of the reciprocating member 213, the pump portion 210 repeats expansion and contraction. That is, the reciprocating member 213 is moved in the direction indicated by the arrow X, to thereby expand the pump portion 210. The expansion of the pump portion 210 lowers an inner pressure in the toner container T, and causes air to be taken in from the outlet 211. This loosens the toner in the discharge portion 212. The movement of the reciprocating member 213 in a direction reverse to the direction indicated by the arrow X causes the pump portion 210 to be contracted. The contraction of the pump portion 210 increases the inner pressure in the toner container T, and the toner deposited at the outlet 211 is supplied from the outlet 211 to the developing device 100. In short, the drive motor 604 functions as a drive source configured to rotate the toner container T mounted to the mount 310, to thereby expand and contract the pump portion 210.

A memory 223 configured to store the information (replenishment information) relating to the toner container T, which is described above, is attached to the cap portion 222. The CPU 701 causes the replenishment information manager 224 to read the replenishment information on the toner container T from the memory 223. The replenishment information includes the identification information on the toner container T. For example, the CPU 701 performs identification processing on the toner container T based on the identification information stored in the memory 223.

The CPU 701 causes the identification information on the toner container T acquired from the memory 223 to be stored in the RAM 703 and the nonvolatile memory 708. Therefore, the CPU 701 can refer to the most recent identification information in the RAM 703 and the nonvolatile memory 708. The identification information stored in the RAM 703 and the nonvolatile memory 708 is used for determining whether or not the toner container T has been replaced in the detection of replacement of a toner container, which is described later. The replenishment information further includes the value of the number of rotations of the toner container T. Each time the toner container T is rotated by a predetermined number of rotations, for example, ½ rotation, the CPU 701 causes the replenishment information manager 224 to update the information on the number of rotations of the toner container T, which is stored in the memory 223.

The cap portion 222 includes a sealing member **222*b* configured to seal the outlet 211. It is possible to prevent the toner in the toner container T from leaking out of the outlet 211 by sealing the outlet 211 with the sealing member 222*b*. The sealing member 222*b* is removed when the toner container T is mounted to the mount 310. The removal of the sealing member 222*b* releases the outlet 211** of the toner container T.

FIG. 5B is an illustration of a state in which the pump portion 210 of the toner container T is expanded to a maximum. FIG. 5C is an illustration of a state in which the pump portion 210 of the toner container T is contracted to a maximum. The pump portion 210 is a bellows-like pump made of resin, which is variable in capacity in accordance with expansion and contraction motion. That is, the pump portion 210 is formed of "mountain-fold" portions and "valley-fold" portions arranged alternately and repeatedly along the longitudinal direction of the toner container T.

In this embodiment, a replenishment operation for the toner is performed two times while the toner container T is rotated by one round. One round of the replenishment operation starts with a state in which the pump portion 210 is contracted to a maximum, followed by expansion and contraction, and ends with a state in which the pump portion 210 is contracted to a maximum again. To that end, the cam groove 214 is formed to have two peak portions and two valley regions in order of "valley→peak→valley→peak".

While a position of the cam groove 214 engaged with the reciprocating member 213 is changed from the valley to the peak, the pump portion 210 is being expanded to a maximum. While the position of the cam groove 214 engaged with the reciprocating member 213 is changed from the peak to the valley, the pump portion 210 is being contracted to a maximum. In a case where the position of the cam groove 214 engaged with the reciprocating member 213 is at the valley, the pump portion 210 maintains the state of being contracted to a maximum.

Rotation Detection Sensor

Figure 6A:
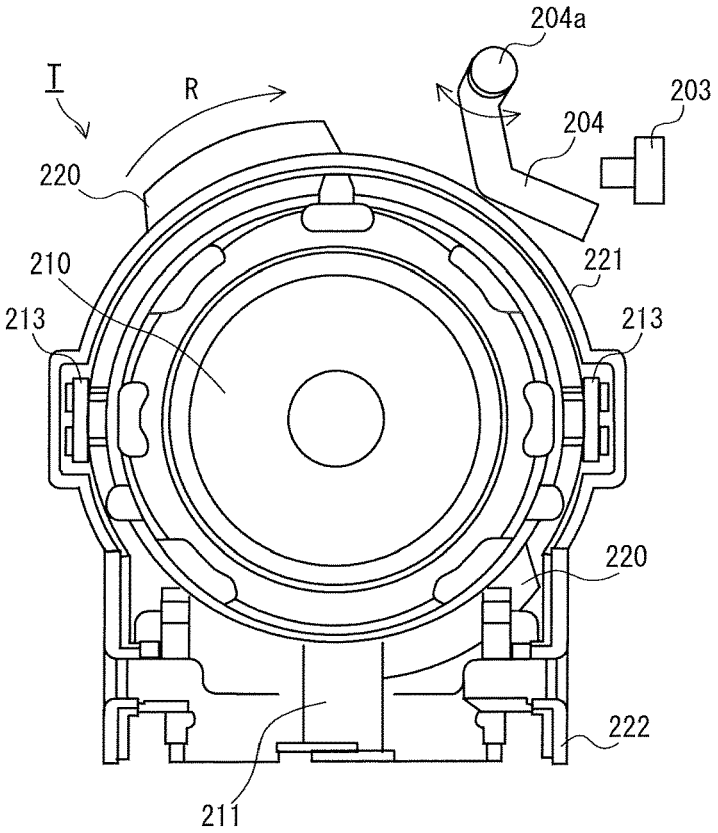
FIG. 6A and FIG. 6B are explanatory diagrams of a rotation detection sensor.
Figure 6B:
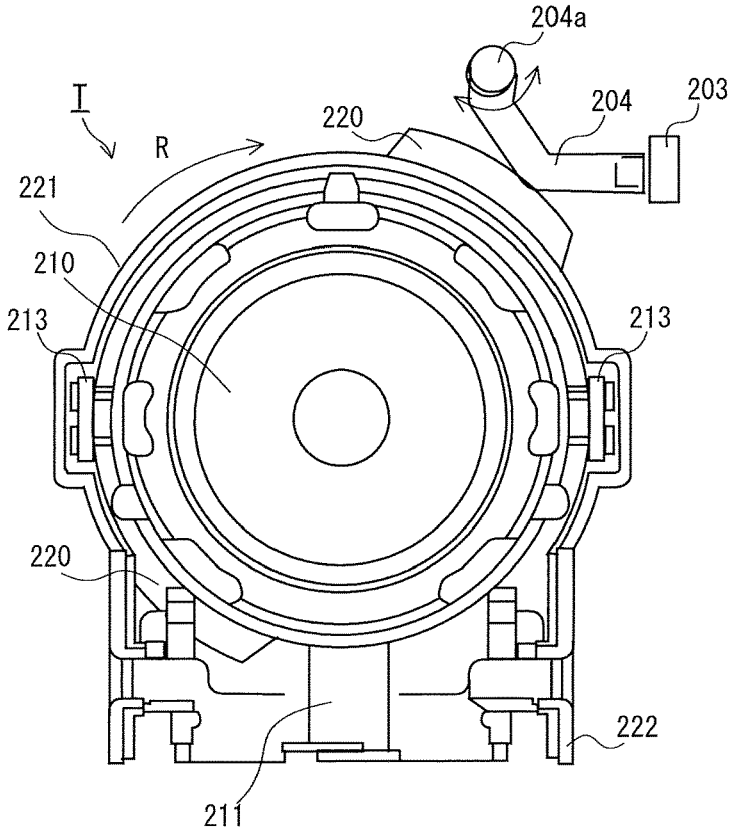

FIG. 6A and FIG. 6B are explanatory diagrams of the rotation detection sensor 203. As described above, the rotation detection sensor 203 is the optical sensor including the light emitter and the light receiver configured to receive light emitted from the light emitter. The rotation detection sensor 203 detects the rotation of the toner container T based on a change in light receiving state of the light receiver due to a flag 204. The flag 204 is a bending member configured to swing about a rotary shaft 204*a*.

The flag 204 has a bent part brought into contact with the detected portion 221 of the toner container T due to its self-weight. With the bent part of the flag 204 being in contact with the detected portion 221, a free end being a tip portion of the flag 204 is not brought into contact with the rotation detection sensor 203. Under this state, light from the light emitter of the rotation detection sensor 203 is received by the light receiver without being blocked. When brought into contact with the convex portion 220 of the drive transmission portion 206, the flag 204 is lifted up to have the free end brought into contact with the rotation detection sensor 203. Under this state, the light from the light emitter of the rotation detection sensor 203 is blocked to fail to be received by the light receiver.

In this manner, the rotation detection sensor 203 can determine whether or not the flag 204 is in contact with the convex portion 220. The rotation detection sensor 203 detects the contact between the flag 204 and the convex portion 220, to thereby be able to detect a rotation position (rotation angle) of the toner container T. That is, the rotation detection sensor 203 can detect a rotation position at which the convex portion 220 of the toner container T is brought into contact with the flag 204.

FIG. 6A is an illustration of a state in which the flag 204 is brought into abutment with the detected portion 221. The detected portion 221 overlaps with a region in which the convex portion 220 of the drive transmission portion 206 is formed, and is a region different from the convex portion 220 in the rotation direction of the drive transmission portion 206. In this case, the flag 204 does not block the light from the light emitter of the rotation detection sensor 203. Therefore, the light receiver receives the light emitted from the light emitter. The amount of light received by the light receiver thus becomes equal to or larger than the threshold value. The sensor output detector 705 outputs a low-level signal due to the fact that the amount of light received by the light receiver is equal to or larger than the threshold value. In short, the sensor output detector 705 transmits a low-level signal to the CPU 701 while the flag 204 is in contact with the detected portion 221.

FIG. 6B is an illustration of a state in which the flag 204 is brought into abutment with the convex portion 220. In this case, the flag 204 blocks the light from the light emitter of the rotation detection sensor 203. Therefore, the light receiver does not receive the light emitted from the light emitter. The amount of light received by the light receiver thus becomes smaller than the threshold value. The sensor output detector 705 outputs a high-level signal due to the fact that the amount of light received by the light receiver is smaller than the threshold value. In short, the sensor output detector 705 transmits a high-level signal to the CPU 701 while the flag 204 is in contact with the convex portion 220.

The CPU 701 detects a position of the convex portion 220 based on a level of the signal acquired from the sensor output detector 705. This enables the CPU 701 to detect a rotation phase of the toner container T. After the signal output from the sensor output detector 705 is changed from a high level to a low level, the pump portion 210 of the toner container T starts to be expanded. While the signal output from the sensor output detector 705 maintains a low level, the pump portion 210 is being expanded to a maximum and then starts to be contracted. Before the signal output from the sensor output detector 705 is changed from a low level to a high level, the pump portion 210 shifts to the state of being contracted to a maximum. In short, while the flag 204 is in abutment with the detected portion 221, the pump portion 210 is being contracted to supply the toner to the developing device 100.

Detection of Replacement of Toner Container

When the toner container T is mounted to the mount 310 with a predetermined rotation angle, the flag 204 is brought into a state of being lifted up by the convex portion 220. That is, when the user mounts the toner container T to the mount 310 with the predetermined rotation angle, the signal output by the rotation detection sensor 203 is changed from a low level to a high level. Therefore, the CPU 701 can determine whether or not the toner container T has been mounted to the mount 310 of the image forming apparatus 200 with the predetermined rotation angle based on the output from the rotation detection sensor 203.

Figure 7A:
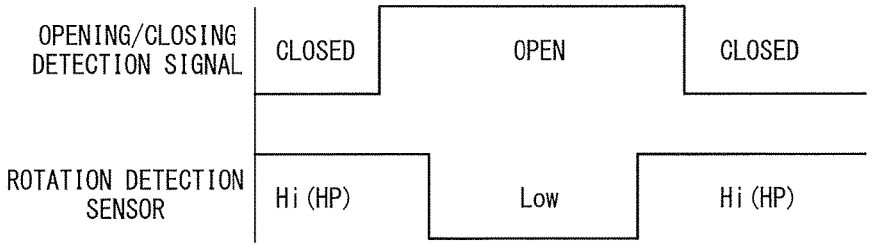
FIG. 7A and FIG. 7B are explanatory diagrams of respective output timings to output signals from a cover opening/closing switch and the rotation detection sensor.
Figure 7B:
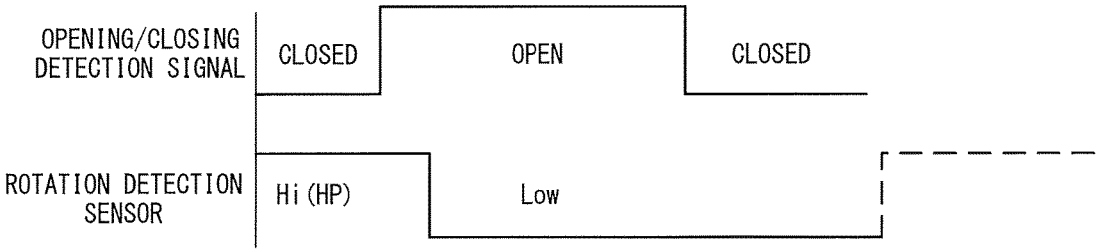

FIG. 7A and FIG. 7B are explanatory diagrams of respective output timings to output a signal from the cover opening/closing switch 27 and a signal from the rotation detection sensor 203 when the toner container T is replaced. In FIG. 7A and FIG. 7B, in a case where the replenishment operation for the toner is not executed, the toner container T is in a stopped state at a home position (HP). At the home position, the flag 204 is lifted up by the convex portion 220 of the toner container T. Therefore, an output signal from the sensor output detector 705 is at a high level. In a case where the cover 26 is not opened, the opening/closing detection signal being the output signal from the cover opening/closing switch 27 is at a low level.

With reference to FIG. 7A, a description is given of a case of replacing the toner container T. The user opens the cover 26. When the cover 26 is brought into an open state, the opening/closing detection signal from the cover opening/closing switch 27 is changed to a high level. When the user detaches the toner container T from the mount 310, the output signal from the sensor output detector 705 is changed from a high level to a low level. This is because, when the toner container T is detached, the free end of the flag 204 is retracted from a position between the light emitter and the light receiver due to its self-weight. When the free end of the flag 204 is retracted from the position between the light emitter and the light receiver, the light from the light emitter of the rotation detection sensor 203 is stopped being blocked, and thus the output signal from the sensor output detector 705 is brought to a low level.

After that, when the user mounts a new toner container T to the mount 310 with the predetermined rotation angle, the output signal from the sensor output detector 705 is brought to a high level. When the user closes the cover 26, the opening/closing detection signal from the cover opening/closing switch 27 is brought to a low level.

With such replacement processing for the toner container T, while the opening/closing detection signal from the cover opening/closing switch 27 is at a high level (while the cover 26 is in an open state), the output signal from the sensor output detector 705 is being changed from a high level to a low level. Then, while the opening/closing detection signal from the cover opening/closing switch 27 is at a high level (while the cover 26 is in an open state), the output signal from the sensor output detector 705 is being changed from a low level to a high level. The CPU 701 can determine that the toner container T has been mounted after temporarily being pulled out based on the fact that the output signal from the sensor output detector 705 has been changed in order of "high level→low level→high level" while the opening/closing detection signal from the cover opening/closing switch 27 maintains a high level.

However, as illustrated in FIG. 7B, the cover 26 may be closed in a case where the output signal from the sensor output detector 705 is at a low level. This is a case in which, for example, the cover 26 is closed while the toner container T has not been mounted to the mount 310 yet. The same applies to the output signal obtained when the toner container T is not mounted to the mount 310 correctly (is not mounted with the predetermined rotation angle). Therefore, the CPU 701 cannot determine whether or not the toner container T is mounted to the mount 310 when the output signals from the cover opening/closing switch 27 and the rotation detection sensor 203 exhibit such a waveform as illustrated in FIG. 7B.

In a case where the cover opening/closing switch 27 and the rotation detection sensor 203 output such output signals as illustrated in FIG. 7B, in order to detect presence or absence of the toner container T, the image forming apparatus 200 according to this embodiment causes the drive motor 604 to rotate the toner container T. In a case where the toner container T is mounted to the mount 310, the convex portion 220 of the toner container T is detected by the rotation detection sensor 203 in accordance with the rotation. That is, the CPU 701 causes the drive motor 604 to rotate the toner container T. The CPU 701 can determine that the toner container T is mounted to the mount 310 when the output signal from the rotation detection sensor 203 is changed from a low level to a high level.

The user may replace the toner container T while the image forming apparatus 200 is in a powered-off state. In such a case, the replacement of the toner container T is determined by comparing the identification information on the toner container T and the identification information on the toner container T stored in the nonvolatile memory 708 with each other when the image forming apparatus 200 is powered on. That is, when the image forming apparatus 200 is powered on, the CPU 701 causes the replenishment information manager 224 to read the replenishment information on the toner container T from the memory 223, to thereby acquire the identification information on the toner container T. The CPU 701 also acquires the identification information on the toner container T stored in the nonvolatile memory 708 during power on before power off. The CPU 701 compares those two pieces of identification information with each other, to thereby be able to determine that the toner container T was replaced during power off in a case where the two pieces of identification information are different from each other.

Screen Display

FIG. 8A, FIG. 8B, and FIG. 8C are diagrams for illustrating examples of a screen to be displayed on the display 707 of the operating device 706.

FIG. 8A is an illustration of an example of the warning screen displayed on the display 707 when the toner container T is replaced by another toner container T' with toner having an amount equal to or larger than a predetermined amount remaining in the toner container T while the image forming apparatus 200 is in a powered-on state. The replacement performed with toner having an amount equal to or larger than a predetermined amount remaining in the toner container T is referred to as "replacement performed at some midpoint".

The warning screen illustrated in FIG. 8A includes information relating to the color (yellow in this case) of the toner container T replaced at some midpoint. The warning screen also includes a message for prompting the user to restore another toner container T' mounted to the mount 310 to the toner container T detached last time. The image forming apparatus 200 can use such a warning screen to inform the user that toner having an amount equal to or larger than a predetermined amount remains in the replaced toner container T. In this case, the CPU 701 also suspends the image forming operation. To "suspend the image forming operation" means that the image forming apparatus 200 stores a print job without performing image formation (printing).

When the toner container T is mounted to the mount 310 during power on, the CPU 701 acquires the identification information from the memory 223 of the toner container T, and stores the identification information in the RAM 703. When the toner container T is replaced during power on, the CPU 701 acquires new identification information from the toner container T' after the replacement. The CPU 701 compares the newly-acquired identification information and the identification information stored in the RAM 703 with each other. In a case where the compared pieces of identification information are different from each other with some toner remaining in the toner container T before the replacement, the CPU 701 determines that the toner container T was replaced at some midpoint. In a case where the compared pieces of identification information are the same, the CPU 701 determines that the toner container T before the replacement has been mounted again.

FIG. 8B is an illustration of an example of the warning screen displayed on the display 707 in a case where the following two conditions are both established after the image forming apparatus 200 is powered on from the powered-off state.

(1) The identification information on the toner container T' after the replacement, which has been acquired from the memory 223 by the replenishment information manager 224, and the identification information on the toner container T before the replacement, which is stored in the nonvolatile memory 708, are different from each other.

(2) The toner having an amount equal to or larger than a predetermined amount remains in the toner container T before the replacement stored in the nonvolatile memory 708 (which is the replacement performed at some midpoint).

The warning screen illustrated in FIG. 8B includes a message for prompting the user to again replace another toner container T' mounted to the mount 310 by the toner container T before the replacement. The warning screen also includes a message for informing the user that the printing can be executed in the monochrome print mode.

This embodiment is described on the assumption that the warning screen illustrated in FIG. 8B is displayed after the toner container Ta containing the toner of yellow is replaced at some midpoint. In this case, the execution of a print job in the color print mode using the toner of yellow is suspended. The toner container Td of black has not been replaced at any midpoint, and thus the image forming apparatus 200 can execute a print job in the monochrome print mode.

When an OK button is pressed on the warning screen illustrated in FIG. 8B, the CPU 701 changes the screen displayed on the display 707 to a guidance screen for a print job, which is illustrated in FIG. 8C. The guidance screen illustrated in FIG. 8C indicates that a print job in the monochrome print mode (monochrome copy) can be executed and that a print job in the color print mode cannot executed. On the guidance screen, a button for performing print setting for the monochrome print mode is displayed. In addition, a message displayed in a lower part of the guidance screen indicates that it is also possible to execute a print job in the color print mode by again mounting the toner container Ta of yellow before the replacement, in which toner having an amount equal to or larger than a predetermined amount remains.

Replacement Confirmation Processing for Toner Container

Figure 9:
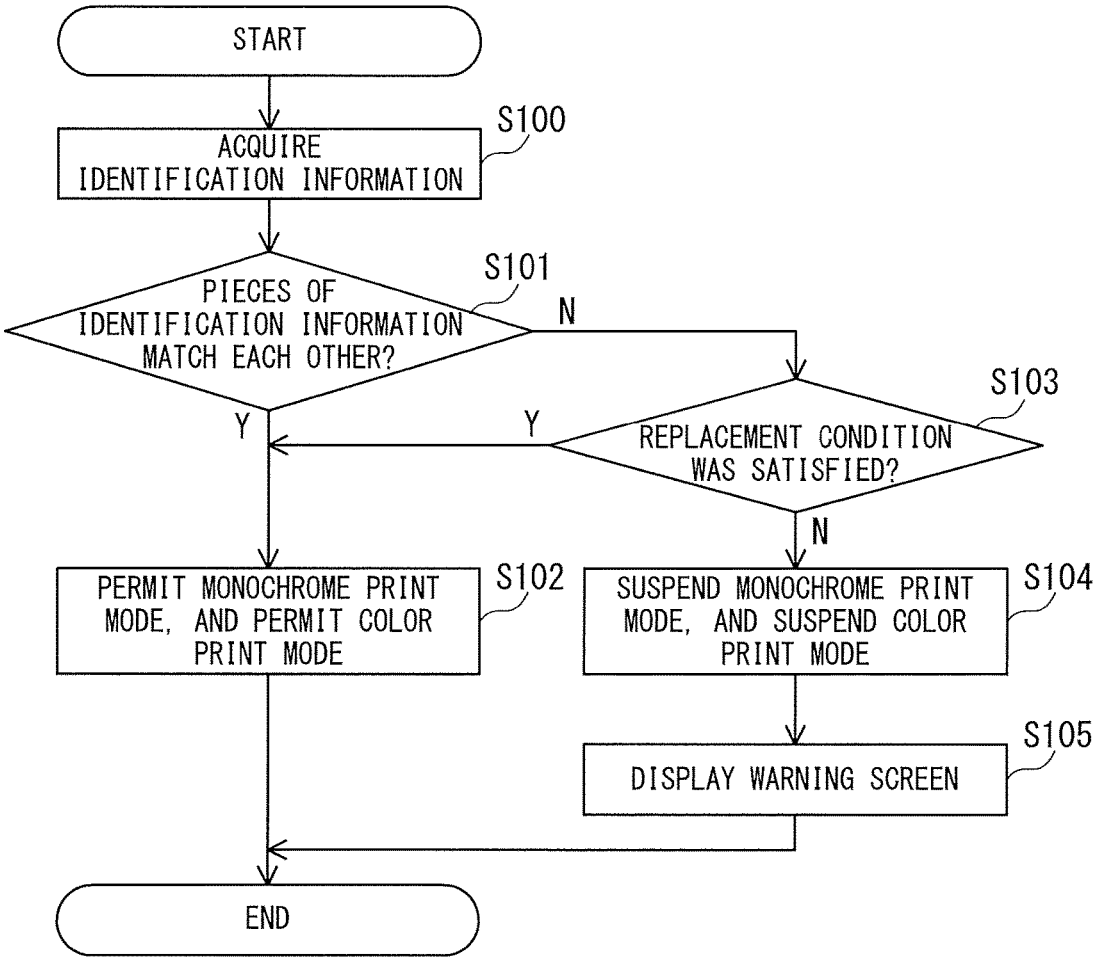
FIG. 9 is a flow chart for illustrating replacement confirmation processing for the toner container.

FIG. 9 is a flow chart for illustrating replacement confirmation processing for the toner container T in the image forming apparatus 200 during power on. After the image forming apparatus 200 is powered on, the CPU 701 causes the replenishment information manager 224 to acquire the replenishment information on the toner container T mounted to the mount 310. The replenishment information includes, for example, the color of the toner contained in the toner container T, the identification information on the toner container T, and the replenishment history of the toner container T. The CPU 701 stores the replenishment information in the RAM 703.

The CPU 701 starts the replacement confirmation processing when the opening/closing detection signal from the cover opening/closing switch 27 is changed from a low level (cover closed state) to a high level (cover open state) with an amount of the toner in the toner container T being equal to or larger than a predetermined amount. For example, the CPU 701 determines whether or not the amount of the toner in the toner container T is equal to or larger than the predetermined amount based on the number of rotations of the toner container T. That is, the CPU 701 determines that the amount of the toner in the toner container T is equal to or larger than the predetermined amount in a case where the number of rotations of the toner container T is smaller than a predetermined number. The toner container T in this embodiment has a fixed amount of the toner discharged from the toner container T by one replenishment operation. Therefore, the CPU 701 can determine the amount of the toner remaining in the toner container T based on the number of rotations of the toner container T.

The CPU 701 determines whether or not the toner container T mounted to the mount 310 satisfies a replacement condition. For example, the CPU 701 determines that the replacement condition is satisfied with the amount of the toner in the toner container T being smaller than the predetermined amount in a case where the number of rotations of the toner container T is equal to or larger than a predetermined number. In a case where the number of rotations of the toner container T is smaller than the predetermined number, the CPU 701 determines that the replacement condition is not satisfied with the amount of the toner in the toner container T being equal to or larger than the predetermined amount. The CPU 701 stores, in the RAM 703, the determination result as to whether or not the toner container T satisfies the replacement condition. When the image forming apparatus 200 is powered off, the CPU 701 stores, in the nonvolatile memory 708, the information stored in the RAM 703.

The CPU 701 acquires the identification information from the memory 223 of the toner container T' mounted for replacement while the image forming apparatus 200 is in a powered-on state (Step S100). The CPU 701 determines whether or not the identification information acquired from the memory 223 of the toner container T' after the replacement and the identification information on the toner container T before the replacement match each other (Step S101). In a case where the pieces of identification information match each other (Y in Step S101), the CPU 701 permits the execution of print jobs in the monochrome print mode and the color print mode, and is brought into a standby state for a print job, which brings the processing to an end (Step S102). This is a case in which, for example, the temporarily-detached toner container T is mounted again.

In a case where the pieces of identification information do not match each other (N in Step S101), the CPU 701 determines whether or not the toner container T before the replacement satisfied the replacement condition (Step S103). In a case where the replacement condition was satisfied (Y in Step S103), the CPU 701 permits the execution of print jobs in the monochrome print mode and the color print mode, and is brought into a standby state for a print job, which brings the processing to an end (Step S102). This is a case in which, for example, the toner container T was successfully replaced by another toner container T' after the toner in the toner container T has run out.

In a case where the replacement condition was not satisfied (N in Step S103), the CPU 701 suspends the execution of print jobs in the monochrome print mode and the color print mode (Step S104). This is a case in which, for example, the toner container T was replaced at some midpoint. The CPU 701 displays the warning screen exemplified in FIG. 8A on the display 707 (Step S105). The warning screen is displayed until the user again mounts the toner container T replaced at some midpoint. When the user follows the warning screen to again mount the toner container T that had been mounted before the toner container T was replaced at some midpoint, the suspension of the execution of print jobs is canceled.

Figure 10:
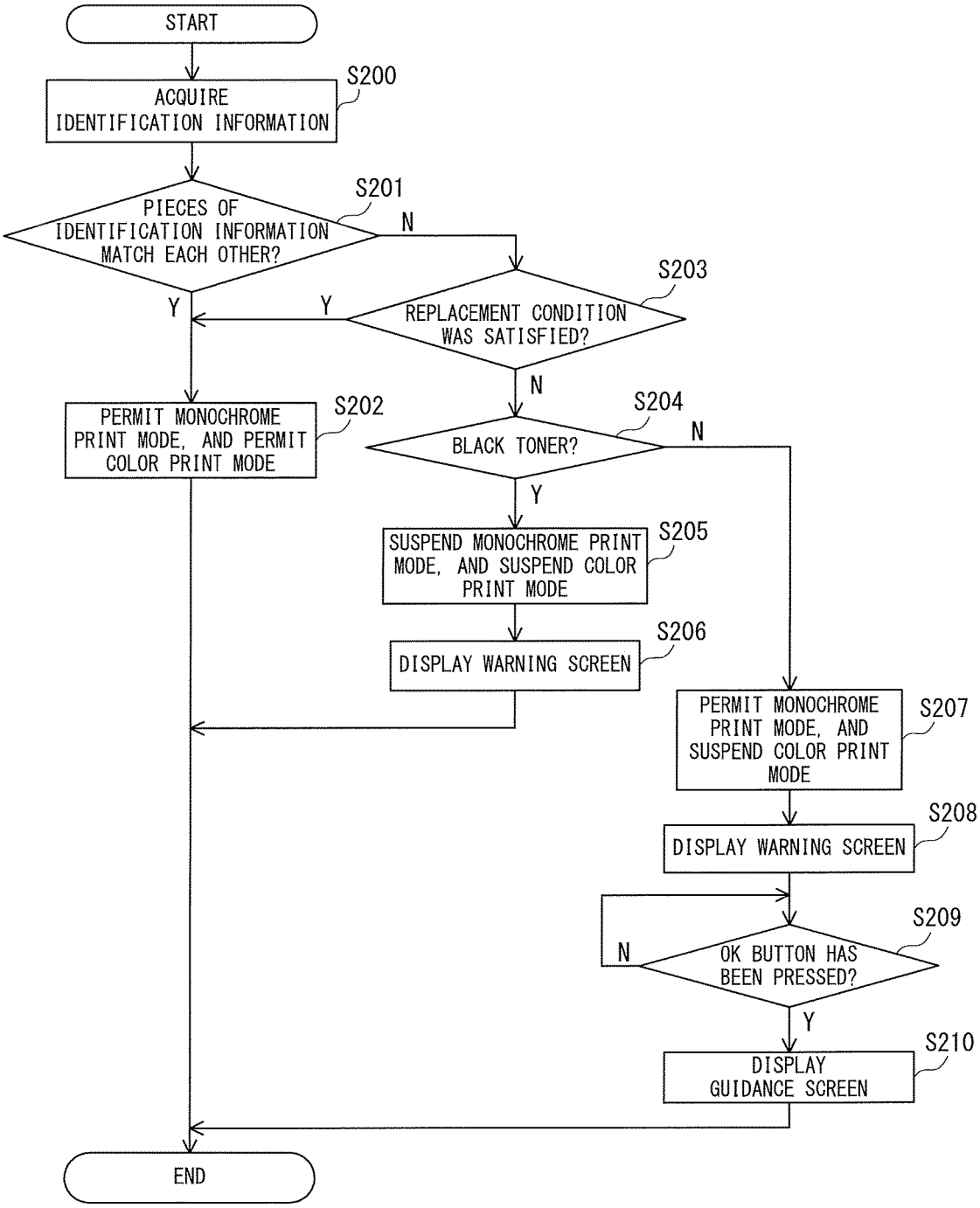
FIG. 10 is a flow chart for illustrating the replacement confirmation processing for the toner container.

FIG. 10 is a flow chart for illustrating the replacement confirmation processing for the toner container T, which is performed by the image forming apparatus 200 when the power is turned on from the powered-off state.

The CPU 701 acquires the identification information from the memory 223 of each of the toner containers Ta, Tb, Tc, and Td when the image forming apparatus is powered on (Step S200). The CPU 701 determines whether or not the acquired identification information on each of the toner containers Ta, Tb, Tc, and Td and the identification information on each toner container stored in the nonvolatile memory 708 match each other (Step S201). The identification information on each toner container stored in the nonvolatile memory 708 is information stored when the image forming apparatus 200 was powered on last time.

In a case where the pieces of identification information match each other (Y in Step S201), the CPU 701 permits the execution of print jobs in the monochrome print mode and the color print mode, and is brought into a standby state for a print job, which brings the processing to an end (Step S202). This is a case in which, for example, the toner container was not replaced while the image forming apparatus 200 was in a powered-off state.

In a case where the pieces of identification information do not match each other (N in Step S201), the CPU 701 determines whether or not the toner container before the replacement satisfied the replacement condition (Step S203). This is a case in which, for example, the toner container was replaced by toner container having different identification information while the image forming apparatus 200 was in a powered-off state.

In a case where the replacement condition was satisfied (Y in Step S203), the CPU 701 permits the execution of print jobs in the monochrome print mode and the color print mode, and is brought into a standby state for a print job, which brings the processing to an end (Step S202). This is a case in which, for example, the toner container was successfully replaced by another toner container after the toner in the toner container has run out.

In a case where there is a toner container that does not satisfy the replacement condition (N in Step S203), the CPU 701 determines that the toner container was replaced at some midpoint while the image forming apparatus 200 was in a powered-off state. The CPU 701 determines whether or not black is included in the colors of the toner containers replaced at some midpoint (Step S204). In a case where the toner container Td of black was replaced at some midpoint (Y in Step S204), the CPU 701 suspends the execution of print jobs in the monochrome print mode and the color print mode (Step S205). The CPU 701 displays the warning screen exemplified in FIG. 8A on the display 707 (Step S206). The warning screen is displayed until the user again mounts the toner container replaced at some midpoint. When the user follows the warning screen to again mount the toner container that had been mounted before the toner container was replaced at some midpoint, the suspension of the execution of print jobs is canceled.

In a case where the toner container Td of black has not been replaced at any midpoint (N in Step S204), the CPU 701 permits the execution of a print job in the monochrome print mode, and suspends the execution of a print job in the color print mode (Step S207). In a case where the toner container was replaced at some midpoint while the image forming apparatus 200 was in a powered-off state, the user who replaced the toner container at some midpoint may be away from the image forming apparatus 200, and the user who has turned on the power may be another user. In that case, it is difficult to immediately restore the toner container that had been mounted before the toner container was replaced at some midpoint. Therefore, the CPU 701 permits the execution of a print job in the monochrome print mode being an executable print mode.

The CPU 701 displays the warning screen illustrated in FIG. 8B on the display 707 (Step S208). The warning screen includes an indication for prompting the user to again mount the toner container containing the toner of a chromatic color, which was replaced at some midpoint, and an indication for informing the user that it is possible to execute a print job in the monochrome print mode. The CPU 701 determines whether or not the OK button on the warning screen has been pressed (Step S209). In a case where the OK button has been pressed (Y in Step S209), the CPU 701 displays the guidance screen illustrated in FIG. 8C on the display 707, and brings the processing to an end (Step S210).

At this time, the image forming apparatus 200 is in a standby state for a print job in the monochrome print mode. The guidance screen guides the user to the fact that it is possible to execute a print job in the monochrome print mode and it is not possible to execute a print job in the color print mode. The guidance screen also guides the user to the fact that color copy is permitted when the toner container replaced at some midpoint is mounted again.

When instructed to execute a print job in the monochrome print mode by the user through the guidance screen, the image forming apparatus 200 again displays the guidance screen after performing a printing operation in the monochrome print mode. When the user again mounts a color bottle replaced at some midpoint, the CPU 701 erases the indication displayed on the guidance screen, and enables the execution of a print job in the color print mode, which has been suspended.

The image forming apparatus 200 may display the warning screen on, for example, a monitor of an external device connected to the image forming apparatus 200 in place of the display 707. The replacement condition for the toner container is determined based on the number of rotations of the toner container, but the present disclosure is not limited thereto. For example, in a case where the amount of the toner in the developing device 100 does not become equal to or larger than a predetermined amount even by rotating the toner container T, the CPU 701 may determine that the amount of the toner remaining in the toner container T is smaller than the predetermined amount, and may determine that the replacement condition has been satisfied. The amount of the toner remaining in the toner container T can be measured by, for example, a method of detecting the amount of the toner remaining in the toner container by a sensor or a method of calculating the amount of the remaining toner based on the number of sheets subjected to the execution of printing after the replacement of the toner container.

In this embodiment, all operations for image formation are suspended in a case where the toner container containing toner of a chromatic color is detected to have been replaced at some midpoint while the image forming apparatus 200 is in a powered-on state. Further, when the power is turned on, the image forming apparatus 200 detects the toner container mounted for replacement during power off. In this case, in a case where the toner container mounted for replacement contains toner of a chromatic color, the image forming apparatus 200 permits the execution of a print job in the monochrome print mode. When detecting that the toner container of a chromatic color was replaced at some midpoint, the image forming apparatus 200 may permit the execution of a print job in the monochrome print mode irrespective of whether the image forming apparatus 200 is in the powered-on state or in the powered-off state. The image forming apparatus 200 may be further configured to permit, in a case where there is a toner container replaced at some midpoint, the execution of printing using a toner container that has not been replaced at any midpoint in addition to printing in the monochrome print mode.

The image forming apparatus 200 according to this embodiment, which has been described above, can perform, even after the toner container was replaced at some midpoint, image formation using toner in a toner container that has not been replaced. In short, an image can be formed using toner (developer) contained in a toner container that has not been replaced, which resolves inconvenience that hinders all operations for image formation from being performed. Therefore, it is possible to reduce an influence exerted on the user by a suspended state of a print job involved in the replacement of a toner container.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-243742, filed Dec. 20, 2017 which is hereby incorporated by reference herein in its entirety.

What is claimed is:

1. An image forming apparatus, comprising:

an image forming unit configured to form an image on a sheet, the image forming unit including:

a first developing unit configured to develop a color image using developer of a chromatic color; and a second developing unit configured to develop a black image using developer of black;

a first mount, to which a first container is to be mounted, the first container being configured to contain the developer of the chromatic color;

a second mount, to which a second container is mounted, the second container being configured to contain the developer of black;

a replenishment mechanism configured to replenish the first developing unit with the developer of the chromatic color from the mounted first container, and replenish the second developing unit with the developer of black from the mounted second container; and a controller configured to:

determine whether the first container is required to be replaced;

suspend, in a case where it is not determined that the first container is required to be replaced and the first container is replaced by another first container, image formation for the color image performed by the image forming unit; and permit, in a case where it is not determined that the first container is required to be replaced and the first container is replaced by the another first container, image formation for the black image performed by the image forming unit.

2. The image forming apparatus according to claim 1, wherein the controller is configured to determine whether the second container is required to be replaced, and wherein the controller is configured to suspend, in a case where it is not determined that the second container is required to be replaced and the second container is replaced by another second container, the image formation for the color image performed by the image forming unit.

3. The image forming apparatus according to claim 1, wherein the controller is configured to determine whether the second container is required to be replaced, wherein the controller is configured to suspend, in a case where it is not determined that the second container is required to be replaced and the second container is replaced by another second container, the image formation for the color image performed by the image forming unit, and wherein the controller is configured to suspend, in a case where it is not determined that the second container is required to be replaced and the second container is replaced by the another second container, the image formation for the black image performed by the image forming unit.

4. The image forming apparatus according to claim 1, further comprising a detector configured to detect an amount of the developer of the chromatic color in the first developing unit, wherein the controller is configured to determine whether the mounted first container is required to be replaced based on the amount of the developer of the chromatic color detected by the detector.

5. The image forming apparatus according to claim 1, further comprising a detector configured to detect an amount of the developer of the chromatic color in the first developing unit, wherein the replenishment mechanism is configured to replenish the first developing unit with the developer of the chromatic color from the mounted first container in a case where the amount of the developer of the chromatic color detected by the detector is smaller than a predetermined amount, and wherein the controller is configured to determine that the mounted first container is required to be replaced in a case where the amount of the developer of the chromatic color detected by the detector is smaller than the predetermined amount after a replenishment operation is performed by the replenishment mechanism.

6. The image forming apparatus according to claim 1, wherein the controller is configured to determine whether the first container has been replaced during a period in which the image forming apparatus is in a powered-on state.

7. The image forming apparatus according to claim 1, further comprising a cover configured to be opened or closed in order to replace the first container mounted to the first mount, wherein the controller is configured to determine whether the first container mounted to the first mount has been replaced by the another first container after the cover is closed.

8. The image forming apparatus according to claim 1, further comprising a display configured to display a screen for prompting a user to again mount the replaced first container, wherein the display is configured to display the screen in a case where it is not determined that the first container is required to be replaced and the first container is replaced by the another first container.

9. The image forming apparatus according to claim 1, further comprising a display configured to display a screen for representing that the image formation for the black image is executable by the image forming unit, wherein the display is configured to display the screen in a case where it is not determined that the first container is required to be replaced and the first container is replaced by the another first container.

10. The image forming apparatus according to claim 1, further comprising a display, wherein the display is configured to display a screen for representing that, in a case where it is not determined that the first container is required to be replaced and the first container is replaced by the another first container, the image formation for the black image is executable by the image forming unit, and wherein the display is configured to display another screen for prompting the user to again mount the replaced second container in a case where it is not determined that the second container is required to be replaced and the second container is replaced by another second container.

11. The image forming apparatus according to claim 1, wherein the controller is configured to execute the image formation for the black image after a command for causing the image forming unit to start the image formation for the black image is received.

12. The image forming apparatus according to claim 1, further comprising a display configured to display a screen for representing that the image formation for the black image is executable by the image forming unit, wherein the display is configured to display the screen in a case where it is not determined that the first container is required to be replaced and the first container is replaced by the another first container, wherein the screen includes a button for causing the image forming unit to start the image formation for the black image, and wherein the controller is configured to execute the image formation for the black image after the button is pressed.

13. The image forming apparatus according to claim 1, wherein the controller is configured to acquire identification information on the first container mounted to the first mount, and determine whether the first container has been replaced by the another first container based on the identification information.

14. A control method for an image forming apparatus, the image forming apparatus including:

an image forming unit configured to form an image on a sheet, the image forming unit including:

a first developing unit configured to develop a color image using developer of a chromatic color; and a second developing unit configured to develop a black image using developer of black;

a first mount, to which a first container is to be mounted, the first container being configured to contain developer of a chromatic color;

a second mount, to which a second container is to be mounted, the second container being configured to contain the developer of black;

a replenishment mechanism configured to replenish the first developing unit with the developer of the chromatic color from the mounted first container, and replenish the second developing unit with the developer of black from the mounted second container; and a controller, the control method, which is executed by the controller, comprising:

determining whether the first container is required to be replaced;

suspending, in a case where it is not determined that the first container is required to be replaced and the first container is replaced by another first container, image formation for the color image performed by the image forming unit; and permitting, in a case where it is not determined that the first container is required to be replaced and the first container is replaced by the another first container, image formation for the black image performed by the image forming unit.

* * * * *